US007830310B1

(12) United States Patent
Sievenpiper et al.

(10) Patent No.: US 7,830,310 B1
(45) **Date of Patent: *Nov. 9, 2010**

(54) ARTIFICIAL IMPEDANCE STRUCTURE

(75) Inventors: Daniel F. Sievenpiper, Santa Monica, CA (US); Joseph S. Colburn, Malibu, CA (US); Bryan Ho Lim Fong, Los Angeles, CA (US); Matthew W. Ganz, Marina del Rey, CA (US); Mark F. Gyure, Oak Park, CA (US); Jonathan J. Lynch, Oxnard, CA (US); John Ottusch, Malibu, CA (US); John L. Visher, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 117 days.

This patent is subject to a terminal disclaimer.

(21) Appl. No.: 11/173,182

(22) Filed: Jul. 1, 2005

(51) Int. Cl.
*H01Q 1/38* (2006.01)

(52) U.S. Cl. ..... 343/700 MS; 343/909

(58) Field of Classification Search ..... 343/700 MS, 343/909, 756

See application file for complete search history.

(56) References Cited

U.S. PATENT DOCUMENTS

| | | | | |
|---|---|---|---|---|
| 4,716,417 | A | 12/1987 | Grumet | 343/708 |
| 5,486,837 | A | 1/1996 | Miller | |
| 5,917,458 | A | 6/1999 | Ho et al. | 343/909 |
| 6,208,316 | B1 | 3/2001 | Cahill | 343/909 |
| 6,262,495 | B1 | 7/2001 | Yablonovitch et al. | 307/101 |
| 6,483,481 | B1 * | 11/2002 | Sievenpiper et al. | 343/909 |
| 6,512,494 | B1 | 1/2003 | Diaz et al. | 343/909 |
| 6,518,931 | B1 | 2/2003 | Sievenpiper | 343/770 |
| 6,552,696 | B1 * | 4/2003 | Sievenpiper et al. | 343/909 |
| 6,624,781 | B1 | 9/2003 | Collins | 342/22 |
| 6,628,242 | B1 | 9/2003 | Hacker | 333/246 |
| 6,657,592 | B2 | 12/2003 | Dening | 343/700 MS |
| 6,690,327 | B2 * | 2/2004 | McKinzie et al. | 343/700 MS |
| 6,768,476 | B2 | 7/2004 | Lilly | 343/909 |
| 6,806,846 | B1 * | 10/2004 | West | 343/909 |
| 7,136,029 | B2 * | 11/2006 | Ramprasad et al. | 343/909 |
| 7,218,281 | B2 * | 5/2007 | Sievenpiper et al. | 343/700 MS |
| 2003/0112186 | A1 | 6/2003 | Sanchez et al. | |

(Continued)

FOREIGN PATENT DOCUMENTS

| | | |
|---|---|---|
| EP | 1 508 940 A1 | 2/2005 |

(Continued)

OTHER PUBLICATIONS

Checcacci, V., et al., "Holographic Antennas", *IEEE Transactions on Antennas and Propagation*, vol. 18, No. 6, pp. 811-813, Nov. 1970.

(Continued)

*Primary Examiner*—Douglas W Owens
*Assistant Examiner*—Dieu Hien T Duong
(74) *Attorney, Agent, or Firm*—Ladas & Parry

(57) ABSTRACT

An artificial impedance structure and a method for manufacturing same. The structure contains a dielectric layer having generally opposed first and second surfaces, a conductive layer disposed on the first surface, and a plurality of conductive structures disposed on the second surface to provide a preselected impedance profile along the second surface.

32 Claims, 10 Drawing Sheets

U.S. PATENT DOCUMENTS

| | | | | |
|---|---|---|---|---|
| 2004/0201526 | A1 | 10/2004 | Knowles et al. | 343/909 |
| 2005/0029632 | A1* | 2/2005 | McKinzie et al. | 257/665 |
| 2006/0050010 | A1* | 3/2006 | Choi et al. | 343/909 |
| 2006/0152430 | A1 | 7/2006 | Seddon et al. | 343/909 |

FOREIGN PATENT DOCUMENTS

| | | | |
|---|---|---|---|
| JP | 2002299951 | A | 10/2002 |
| WO | 2004/093244 | A2 | 10/2004 |
| WO | WO 96/09662 | | 3/2006 |

OTHER PUBLICATIONS

Fathy, A.E., et al., "Silicon-Based Reconfigurable Antennas—Concepts, Analysis, Implementation and Feasibility", *IEEE Transactions on Microwave Theory and Techniques*, vol. 51, No. 6, pp. 1650-1661, Jun. 2003.

King, R., et al., "The Synthesis of Surface Reactance Using an Atificial Dielectric", *IEEE Transactions on Antennas and Propagation*, vol. 31, No. 3, pp. 471-476, May 1993.

Levis, K., et al., "Ka-Band Dipole Holographic Antennas", *IEEE Proceedings of Microwaves, Antennas and Propagation*, vol. 148, No. 2, pp. 129-132, Apr. 2001.

Mitra, R., et al., Techniques for Analyzing Frequency Selective Surfaces—A Review, *Proceedings of the IEEE*, vol. 76, No. 12, pp. 1593-1615, Dec. 1988.

Oliner, A., et al., "Guided waves on sinusoidally-modulated reactance surfaces", *IEEE Transactions on Antennas and Prooagation*, vol. 7, no. 5, pp. 201-208, Dec. 1959.

Pease, R., "Radiation from Modulated Surface Wave Structures II" *IRE International Convention Record*, vol. 5, pp. 161-165, Mar. 1957.

Sazonov, D.M., "Computer Aided Design of Holographic Antennas and Propagation", *IEEE International Symposium of the Antennas and the Propagation Society 1999*. vol. 2, pp. 738-741, Jul. 1999.

Sievenpiper, D., et al., "High-Impedance Electromagnetic Surfaces with a Forbidden Frequency Band", *IEEE Transactions on Microwave Theory and Techniques*, vol. 47, No. 11, pp. 2059-2074, Nov. 1999.

Thomas, A., et al., "Radiation from Modulated Surface Wave Structures I", *IRE International Convention Record*, vol. 5, pp. 153-160, Mar. 1957.

ElSherbiny, et al. "Holographic Antenna Concept, Analysis, and Parameters," IEEE Trans. On Antennas and Propagation, vol. 52, No. 3, Mar. 2004, pp. 830-839 (abstract).

* cited by examiner

Metal plates

Wire grid

Series Resonant

Parallel Resonant

Square rings

Arbitrary rings

ARTIFICIAL IMPEDANCE STRUCTURE

CROSS REFERENCE TO RELATED APPLICATIONS

This application is related to U.S. application Ser. No. 11/173,187, titled "Artificial Impedance Structures," filed on Jul. 1, 2005, which is incorporated herein by reference in its entirety.

FIELD OF THE INVENTION

The present invention relates to conformal antennas. More particularly, the present invention relates to artificial impedance structures used with conformal antennas.

BACKGROUND

A common problem for antenna designers is the integration of low-profile antennas into complex objects such as vehicles or aircraft, while maintaining the desired radiation characteristics. The radiation pattern of an integrated antenna is the result of currents in both the antenna and the surrounding structure. In Prior Art, as shown in FIG. 1*a*, a flat metal sheet 15 excited by a quarter wavelength monopole antenna 16 produces a low gain (about 5 db) radiation pattern in the metal sheet 15 as shown in FIG. 1*b*. Therefore, controlling the radiation from currents generated in metal surfaces like metal sheet 15 can expand the available design space.

According to the present disclosure, artificial impedance structures may provide a more controllable radiation pattern than previous conformal antennas, by configuring the metallic surface to provide scattering or guiding properties desired by the antenna designer. According to the present disclosure, artificial impedance structures may be designed to guide surface waves over metallic surface and to ultimately radiate energy to produce any desired radiation pattern.

PRIOR ART

The prior art consists of three main categories: (1) holographic antennas, (2) frequency selective surfaces and other artificial reactance surfaces, and (3) surface guiding by modulated dielectric or impedance layers.

Example of prior art directed to artificial antennas includes:

1. P. Checcacci, V. Russo, A. Scheggi, "Holographic Antennas", IEEE Transactions on Antennas and Propagation, vol. 18, no. 6, pp. 811-813, November 1970;
2. D. M. Sazonov, "Computer Aided Design of Holographic Antennas", IEEE International Symposium of the Antennas and Propagation Society 1999, vol. 2, pp. 738-741, July 1999;
3. K. Levis, A. Ittipiboon, A. Petosa, L. Roy, P. Berini, "Ka-Band Dipole Holographic Antennas", IEE Proceedings of Microwaves, Antennas and Propagation, vol. 148, no. 2, pp. 129-132, April 2001.

Example of prior art directed to frequency selective surfaces and other artificial reactance surfaces includes:

1. R. King, D. Thiel, K. Park, "The Synthesis of Surface Reactance Using an Artificial Dielectric", IEEE Transactions on Antennas and Propagation, vol. 31, no. 3, pp. 471-476, May, 1983;
2. R. Mittra, C. H. Chan, T. Cwik, "Techniques for Analyzing Frequency Selective Surfaces—A Review", Proceedings of the IEEE, vol. 76, no. 12, pp. 1593-1615, December 1988;

3. D. Sievenpiper, L. Zhang, R. Broas, N. Alexopolous, E. Yablonovitch, "High-Impedance Electromagnetic Surfaces with a Forbidden Frequency Band", IEEE Transactions on Microwave Theory and Techniques, vol. 47, no. 11, pp. 2059-2074, November 1999.

Example of prior art directed to surface guiding by modulated dielectric or impedance layers includes:

1. A. Thomas, F. Zucker, "Radiation from Modulated Surface Wave Structures I", IRE International Convention Record, vol. 5, pp. 153-160, March 1957;
2. R. Pease, "Radiation from Modulated Surface Wave Structures II", IRE International Convention Record, vol. 5, pp. 161-165, March 1957;
3. A. Oliner, A. Hessel, "Guided waves on sinusoidally-modulated reactance surfaces", IEEE Transactions on Antennas and Propagation, vol. 7, no. 5, pp. 201-208, December 1959.

Example of prior art directed to this general area also includes:

1. T. Q. Ho, J. C. Logan, J. W. Rocway "Frequency Selective Surface Integrated Antenna System", U.S. Pat. No. 5,917,458, Sep. 8, 1995;
2. A. E. Fathy, A. Rosen, H. S. Owen, f. McGinty, D. J. McGee, G. C. Taylor, R. Amantea, P. K. Swain, S. M. Perlow, M. ElSherbiny, "Silicon-Based Reconfigurable Antennas—Concepts, Analysis, Implementation and Feasibility", IEEE Transactions on Microwave Theory and Techniques, vol. 51, no. 6, pp. 1650-1661, June 2003.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

Using techniques disclosed in this application, artificial impedance structures may be designed to guide and radiate energy from surface waves to produce any desired radiation pattern. According to the present disclosure, holographic antennas may be implemented using modulated artificial impedance structures that are formed as printed metal patterns.

Figure 1A:
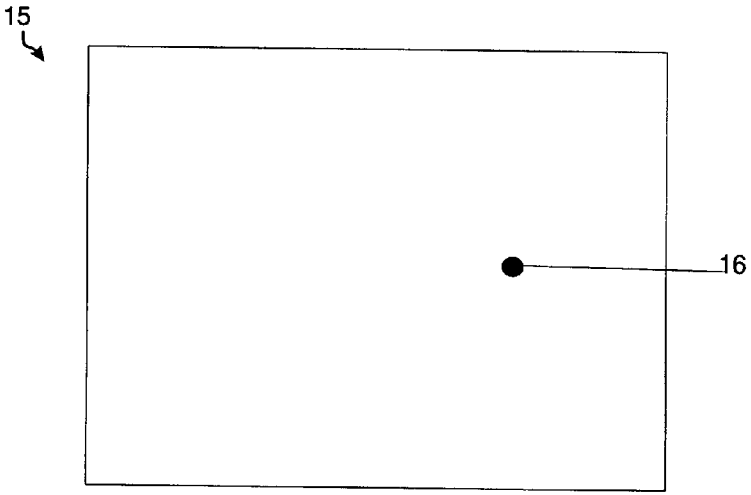
FIG 1a PRIOR ART
FIG. 1*a* relates to Prior Art and depicts a metal sheet excited by a quarter wavelength monopole antenna.
Figure 1B:
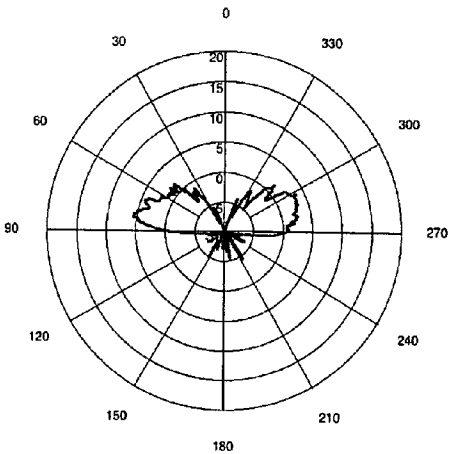
FIG 1b PRIOR ART
FIG. 1*b* relates to Prior Art and depicts a low gain radiation pattern generated by the metal sheet of FIG. 1.
Figure 2:
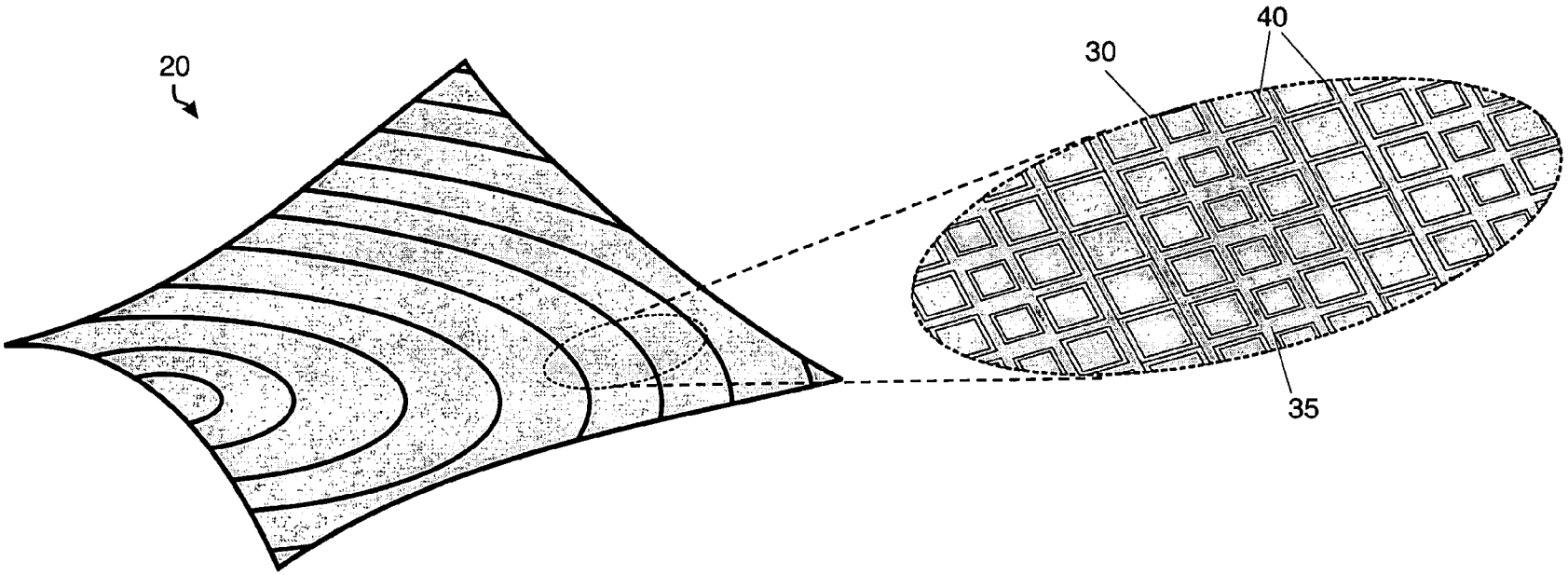
FIG. 2 depicts an artificial impedance structure composed of a single layer of conductive structures in accordance with the present disclosure.

Referring to FIG. 2, an artificial impedance structure 20 may provide nearly any scattering or guiding properties desired by the antenna designer. The artificial impedance structure 20 may be implemented using an artificial impedance surface 30 described in more detail below.

Figure 3B:
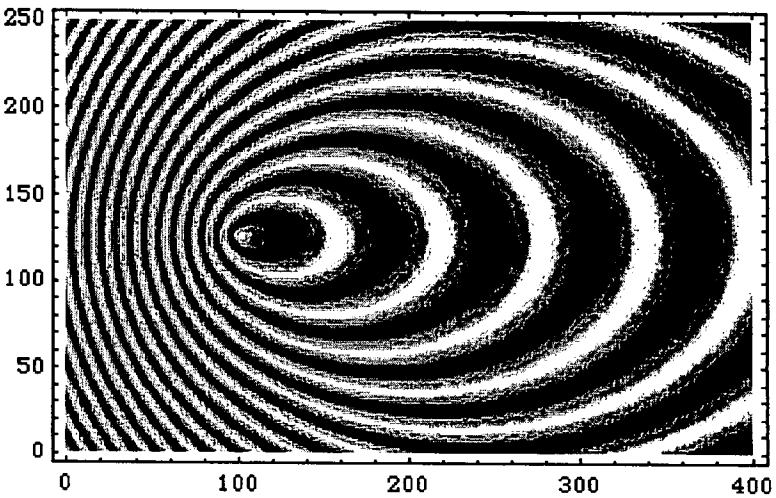
FIG. 3*b* depicts a hologram function defined by the interference pattern between a point source and a plane wave in accordance with the present disclosure.
Figure 3A:
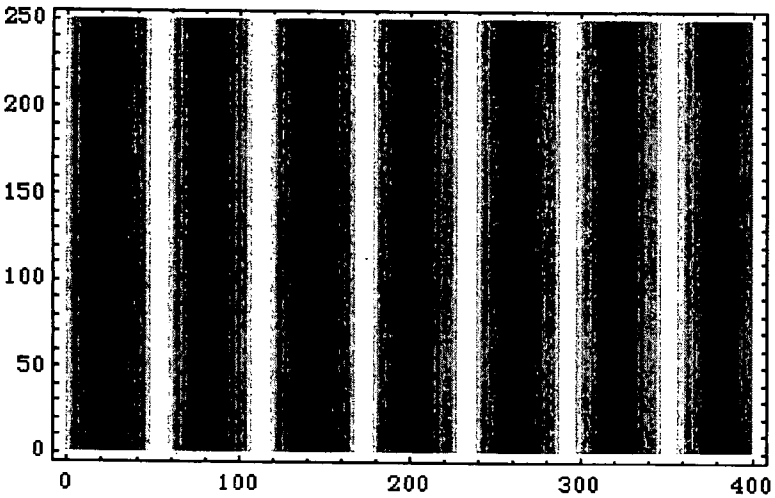
FIG. 3*a* depicts a hologram function defined by the interference pattern between a line source and a plane wave in accordance with the present disclosure.

The artificial impedance structure 20 is designed so that the surface impedance of the artificial impedance structure 20 is formed as a pattern that represents the interference between a source wave and a desired wave. The source wave may be a plane wave represented by $$W_R = e^{\frac{-i2\pi n}{\lambda} x * Sin(\theta)},$$

a line source wave represented by $$W_o = e^{\frac{i2\pi n}{\lambda} x}$$

as shown in FIG. 3*a*, a point source wave represented by $$W_o = e^{\frac{i2\pi n}{\lambda}\sqrt{(x-x_O)^2+(y-y_O)^2}}$$

as shown in FIG. 3*b*, or any other source waves known in the art. The following symbol definitions apply to the above formulas: λ=wavelength; n=effective index of refraction; x,y=coordinates on the surface; θ=angle from the surface; W=wave function; i=imaginary number; π=3.1415 . . . .

The desired wave is the radiation pattern that the surface of the artificial impedance structure 20 is intended to create. The two waves are multiplied together, and the real part is taken. The function $H=Re(W_O W_R)$ defines how the surface impedance varies as a function of position across the surface. Because this method only produces a normalized surface impedance, it may be scaled to the correct value of the impedance. Although impedance values in the range of 160 j ohms provide a good match to a waveguide source, the optimum average impedance depends on the source wave. Furthermore, a modulation depth of the impedance may determine the amount of energy that radiates from the surface, per length. Higher modulation depth may result in a greater radiation rate. For the source wave, it is assumed that a probe generates a surface wave that propagates with a phase velocity determined by the average effective refractive index as calculated in the unit cell simulations. For plane waves, it is assumed that the refractive index is that of the material surrounding the surface, which is often free space.

The surface impedance profile defined by the function $H=Re(W_O W_R)$ may be generated on the artificial impedance structure 20 with the artificial impedance surface 30 that comprises conductive structures 40 printed on a grounded dielectric layer 35 that is thinner than the wavelength of operation.

Figure 4A:
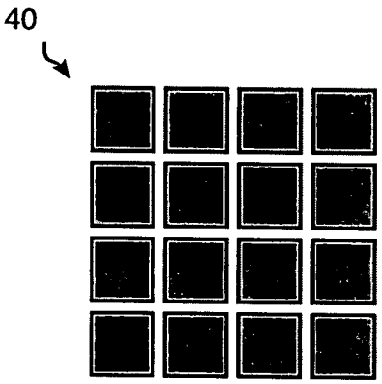
FIGS. 4*a*-4*f* depict exemplary conductive structures that may be used to design the artificial impedance structure of FIG. 2 in accordance with the present disclosure.
Figure 4B:
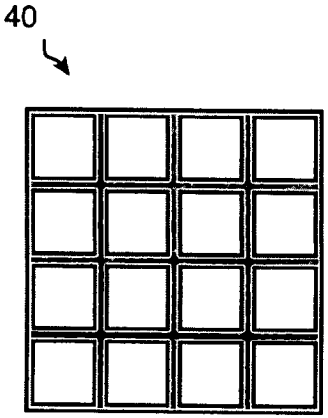
Figure 4C:
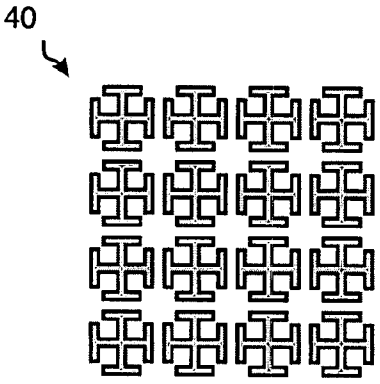
Figure 4D:
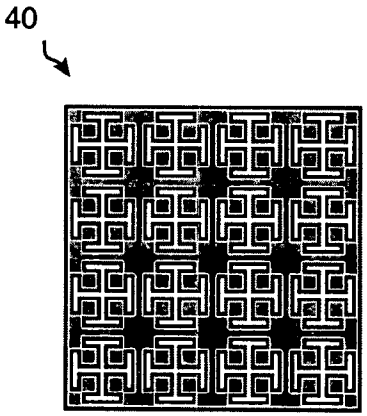
Figure 4E:
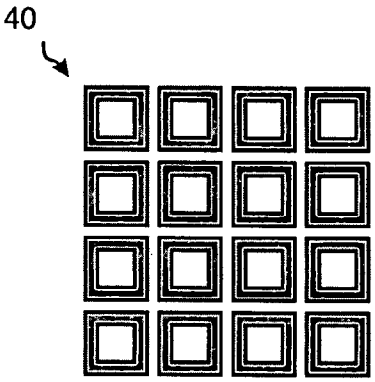
Figure 4F:
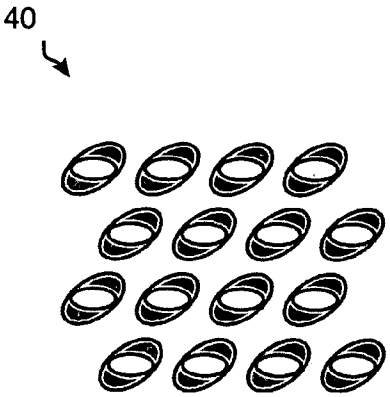

FIGS. 4*a*, . . . , 4*f* depict exemplary embodiments of conductive structures 40 that can be used for the artificial impedance surface 30. The structures shown in FIGS. 4*a*, . . . , 4*f* in general are called frequency selective surfaces, because they are often used in applications where they serve as a filter for microwave signals. Although the structures shown in FIGS. 4*a*, . . . , 4*f* are typically used in a configuration where signals are passing through the surface from one side to the other, presently the structures shown in FIGS. 4*a*, . . . , 4*f* may be used in a configuration where they are printed on a dielectric sheet (not shown) that has a conducting ground plane (not shown) on the opposite side, and where signals travel along the surface of the dielectric sheet rather than passing through the dielectric sheet. The present disclosure is not limited to the structures shown in FIGS. 4*a*, . . . , 4*f*. Other structures may be used to implement the disclosed embodiments.

The conductive structures 40 can be either connected or non-connected, and they may contain fine features within each unit cell such as capacitive or inductive regions in the form of gaps or narrow strips. The patterns of the conductive structures 40 are not limited to square or triangular lattices. The conductive structures 40 can also be connected to the ground plane using, for example, metal plated vias (not shown).

Figure 5:
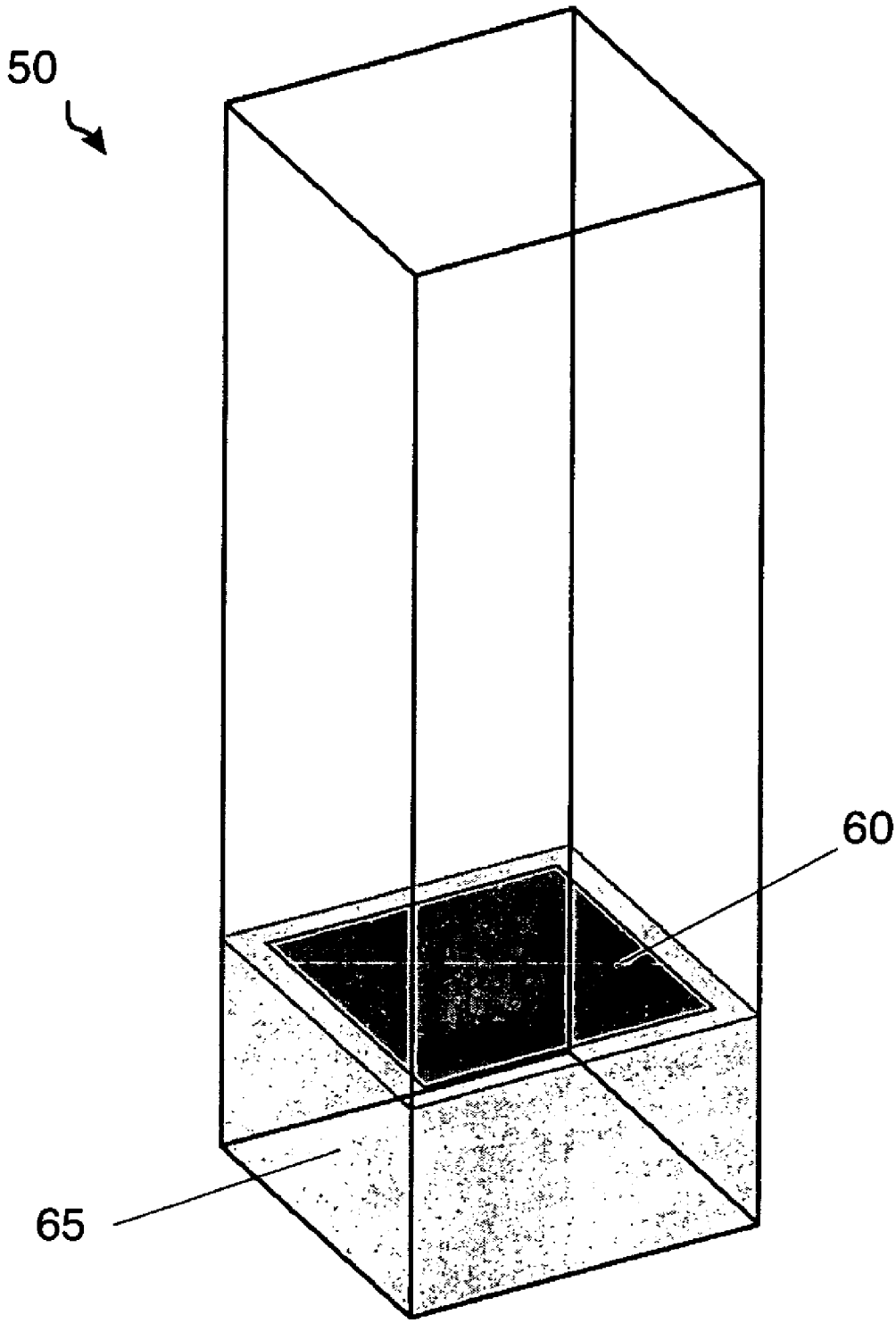
FIG. 5 depicts a unit cell of one of the conductive structures of FIG. 4*a* in accordance with the present disclosure.

Referring to FIG. 5, the artificial impedance surface 30 may be designed by choosing a conductive structure, such as, for example, a small metallic square 60, for a unit cell 50 and determining the surface impedance as a function of geometry by characterizing the unit cell 50 with electromagnetic analysis software.

The single unit cell 50 may be simulated on a block of dielectric 65 that represents the substrate under the small metallic square 60. The bottom of the substrate may also be conductive to represent a ground plane (not shown). The electromagnetic simulation software used to characterize the unit cell 50 determines the Eigenmode frequencies of the unit cell 50. The Eigenmode frequencies determine the effective index, $$n_{eff} = \frac{ck}{\omega} = \frac{c\phi}{a\omega}$$

of a surface wave traveling across a surface comprising a plurality of the small metallic square 60. The following symbol definitions apply to the above formula: $n_{eff}$=effective index of refraction; c=speed of light in vacuum; k=wave number which equals 2*π/λ; ω=angular frequency which equals 2*π*frequency; a=unit cell length ϕ=phase difference across unit cell. The electromagnetic simulation software also determines the surface impedance, $$Z_{eff} = \int_{Cell} \frac{E_x}{H_y} ds,$$

by the averaging ratio of the electric field ($E_x$) and magnetic field ($H_y$).

Figure 6B:
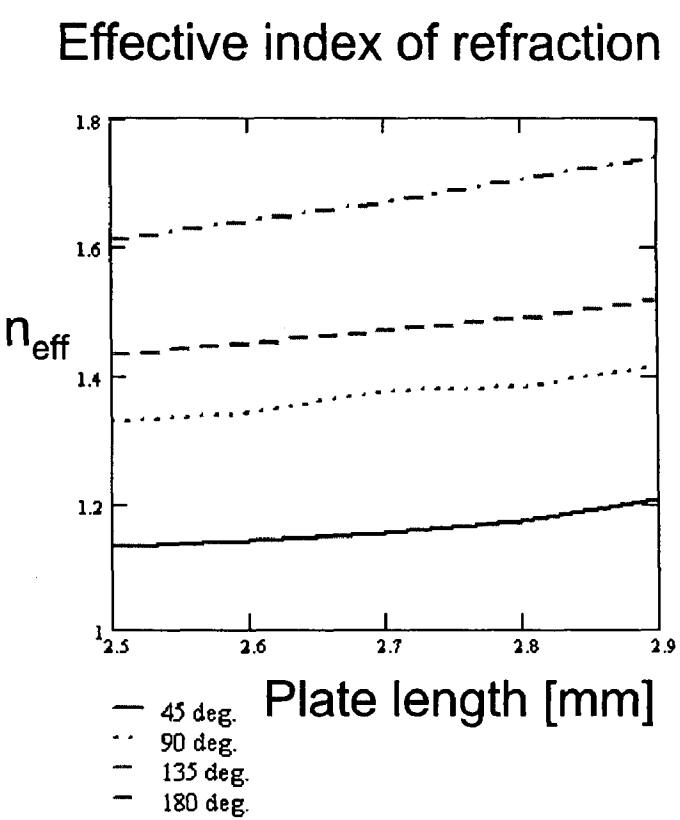
FIGS. 6*a*-6*b* depict a dispersion diagram and an effective index of refraction, respectively, for a unit cell of FIG. 5 in accordance with the present disclosure.
Figure 6A:
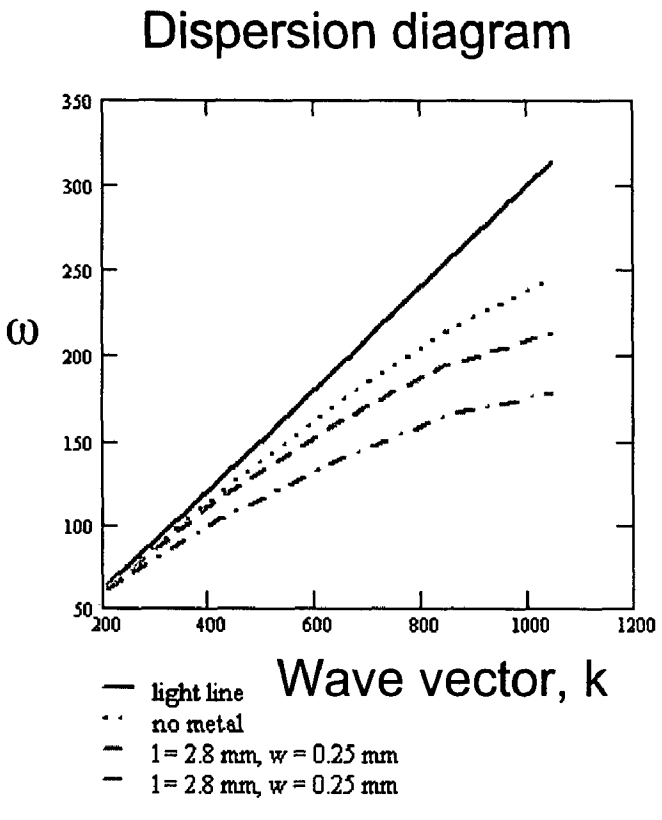

Table 1 shows surface impedance values that were obtained for different square 60 lengths after the simulation of the unit cell 50 using electromagnetic simulation software. The squares 60 was simulated on a 62 mil sheet of Duroid 5880. The impedance of the square 60 is inductive, as seen by the positive imaginary part. FIGS. 6*a* and 6*b* show a dispersion diagram and the effective index of refraction, respectively, based on the simulation of the unit cell 50.

TABLE 1

| Length | $Z_{TM}$ |
|---|---|
| 1 mm | −0.1 + j 67.7 |
| 2 mm | −0.2 + j 71.9 |
| 2.1 mm | −0.1 + j 72.8 |
| 2.2 mm | 0.2 + j 73.7 |
| 2.3 mm | −0.1 + j 75.0 |
| 2.4 mm | 0.2 + j 76.6 |
| 2.5 mm | 0.2 + j 78.8 |
| 2.6 mm | 0.2 + j 81.6 |
| 2.7 mm | 0.1 + j 85.2 |
| 2.8 mm | −0.1 + j 90.2 |
| 2.9 mm | 0.3 + j 102.2 |

Figure 7A:
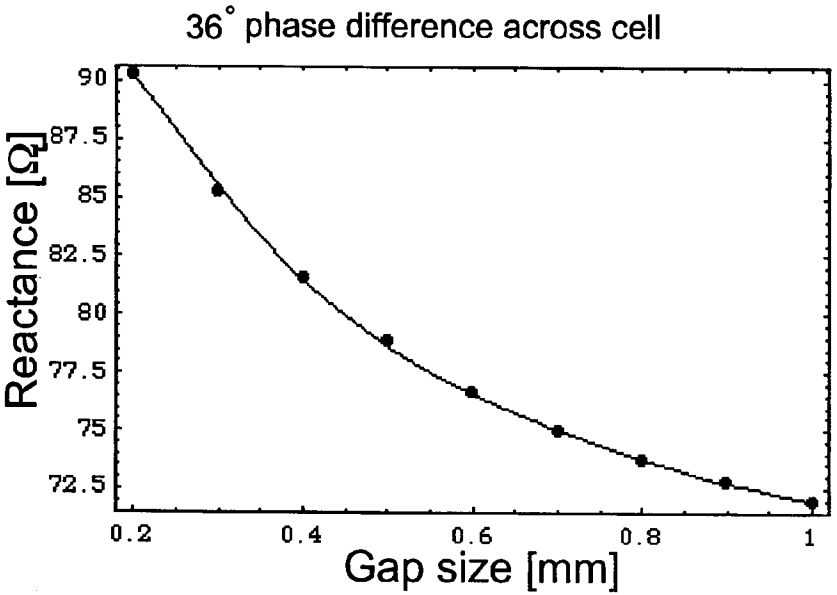
FIGS. 7*a*-7*b* depict plots of the surface reactance versus gap size for a periodic pattern of conductive squares, for two different values of the phase difference across the unit cell in accordance with the present disclosure.
Figure 7B:
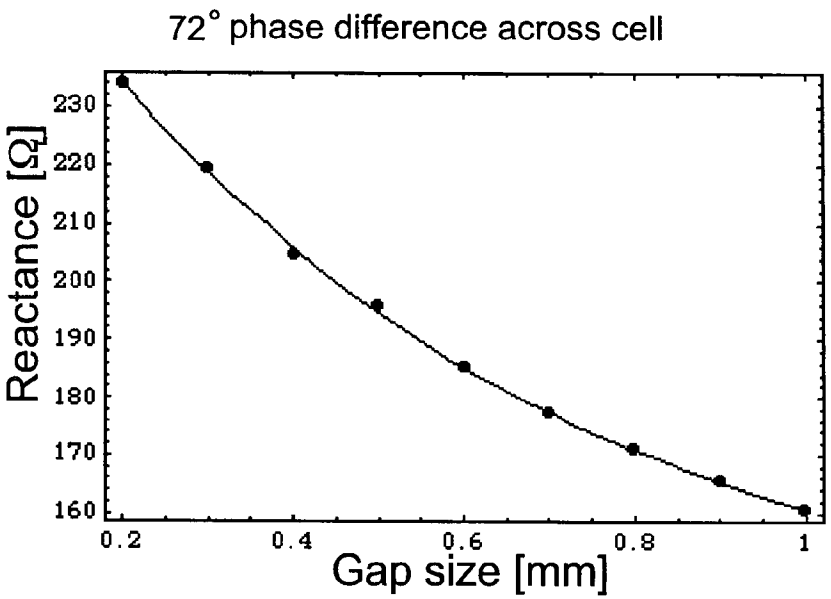

FIGS. 7*a* and 7*b* plot the reactance of the surface in ohms versus the gap size between neighboring squares 60 that can be used to produce different surface impedances profiles based on the simulation of the unit cell 50. The following equations may be obtained to fit the curves shown in the FIGS. 7*a* and 7*b* respectively:

$$Z = 63.7762 + \frac{8.89729}{\gamma} - \frac{0.724152}{\gamma^2}$$

and $$Z = 107 + \frac{62.5335}{\gamma} - \frac{12.7368}{\gamma^2} + \frac{0.943185}{\gamma^3}.$$

By inverting these equations, functions for the gap size versus desired impedance may be obtained.

The unit cell 50 simulations provide a unit cell geometry as a function of the required surface impedance, and the function $H=\mathrm{Re}(W_O W_R)$, disclosed above, defines how the surface impedance varies as a function of position across the surface. These two results can be combined to produce the unit cell geometry as a function of position to generate the artificial impedance structure 20.

Figure 8A:
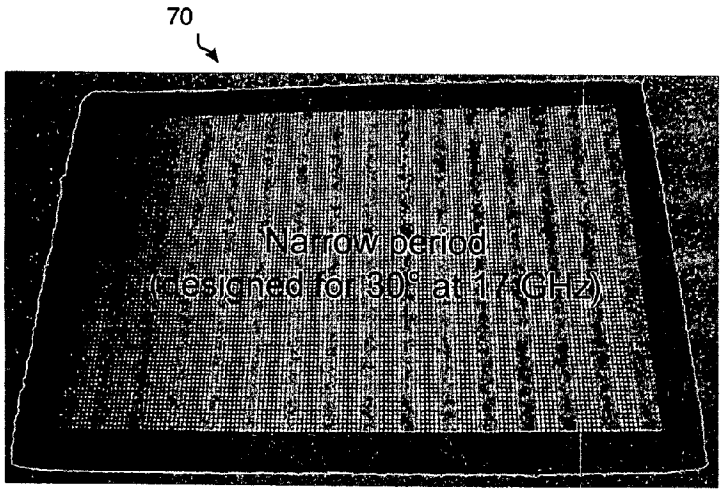
FIGS. 8*a*-8*c* depict exemplary artificial impedance structures in accordance with the present disclosure.
Figure 8B:
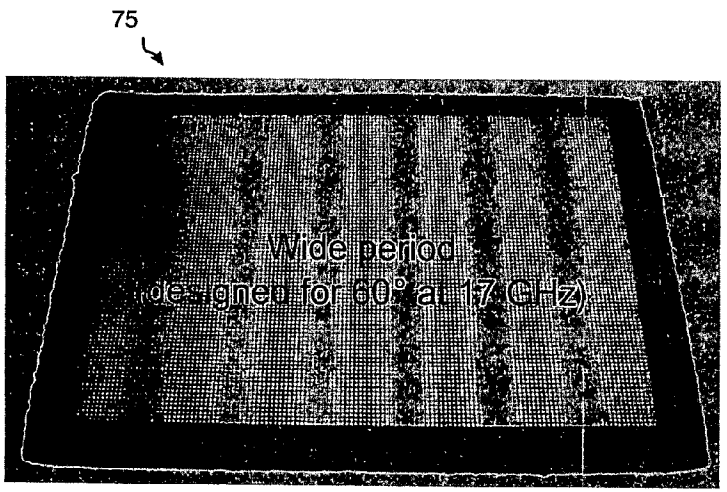
Figure 8C:
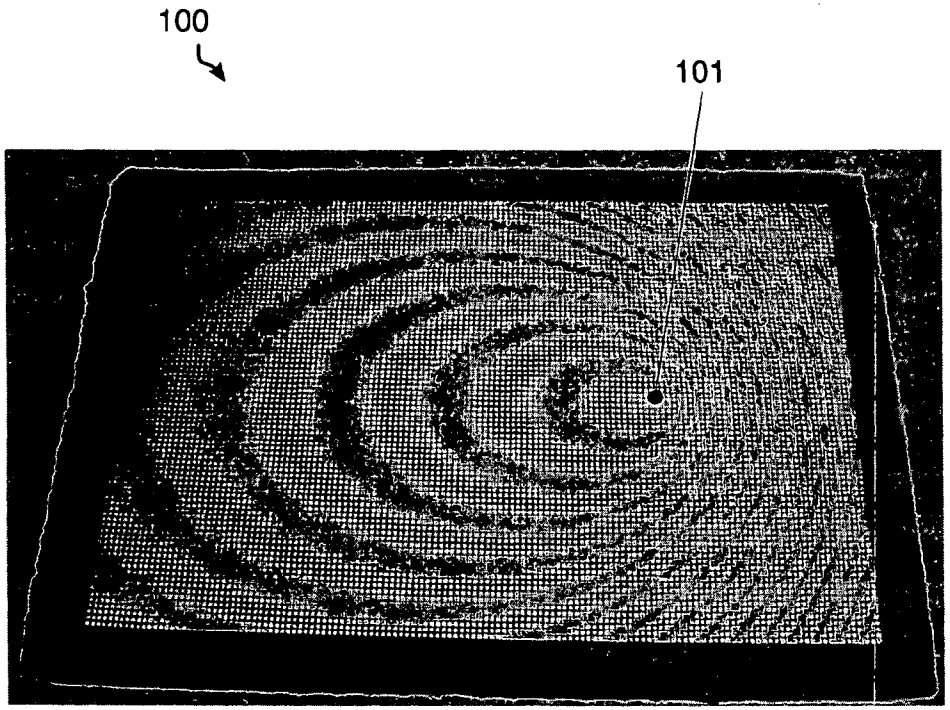

FIGS. 8*a*, 8*b* and 8*c* depict exemplary artificial impedance structures 70, 75 and 100, respectively, designed to radiate at thirty (30) degrees and sixty (60) degrees using techniques described above. The artificial impedance structures 70 and 75 were excited with a waveguide probe (not show) placed against the microwave hologram surfaces 70 and 75. As seen in the radiation patterns in FIGS. 9*a* and 9*b*, the artificial impedance structures 70 and 75 produce the expected result: a narrow beam at the desired angle and high gain represented by lobes 80 and 85, respectfully. The artificial impedance structure 100 was excited by a quarter wavelength monopole antenna 101 disposed on the artificial impedance structure 100. As seen in the radiation pattern in FIG. 9*c*, the artificial impedance structure 100 produces the expected result: a narrow beam at the desired angle and high gain represented by lobe 105.

Figure 9A:
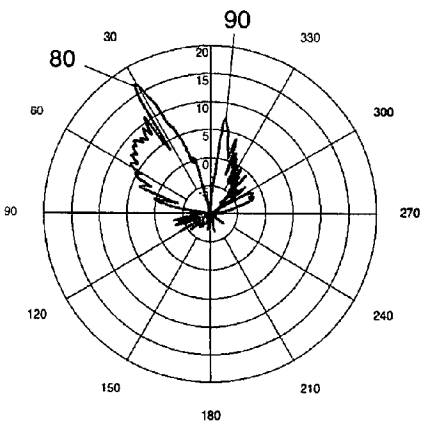
FIGS. 9*a*-9*c* depict high gain radiation patters generated by artificial impedance structure of FIGS. 8*a*, 8*b* and 8*c*, respectively in accordance with the present disclosure.
Figure 9B:
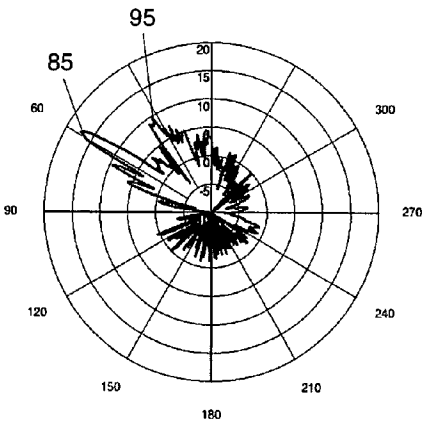
Figure 9C:
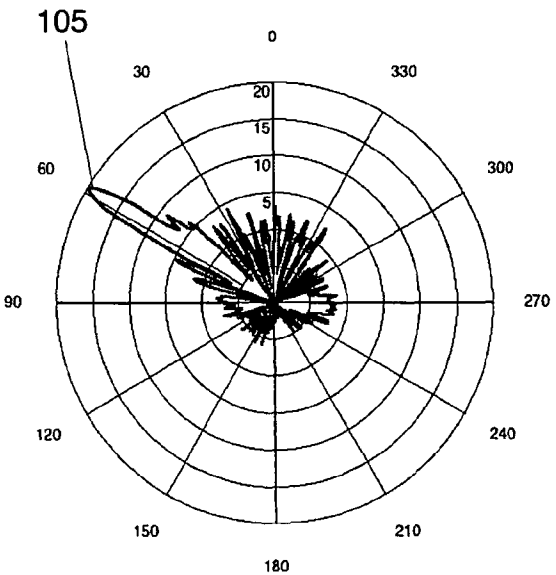

Although higher order diffraction lobes 90 and 95 also occur in the radiation patterns in FIGS. 9*a* and 9*b*, altering the impedance profile of the artificial impedance structure 70 and 75 so as not to be sinusoidal may eliminate the higher order diffraction lobes 90 and 95. The alteration of the impedance profile may be done in a manner similar to that used to create optical diffraction gratings, and the angle for which the grating is optimized is known as the blaze angle. A similar procedure can be used for this microwave grating. It can also be considered as adding additional Fourier components to the surface impedance function that cancel the undesired lobes.

Figure 10A:
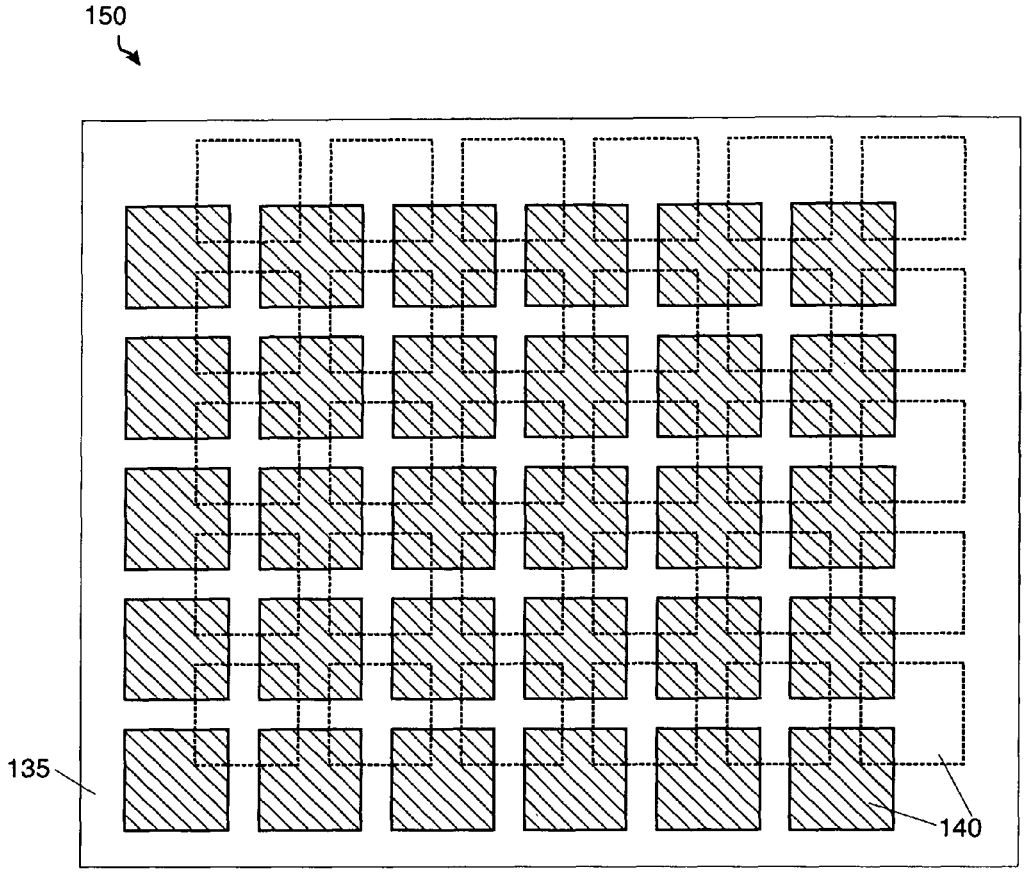
FIG. 10*a* depicts a top view of an artificial impedance structure composed of a multiple layers of conductive shapes in accordance with the present disclosure.
Figure 10B:
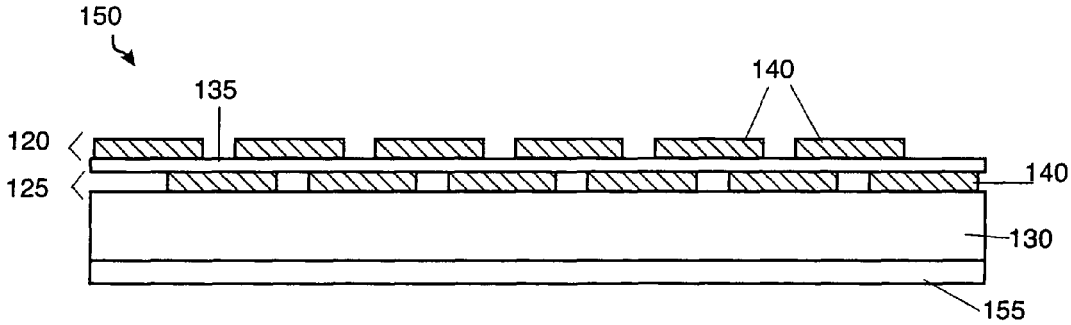
FIG. 10*b* depicts a side view of the artificial impedance structure in FIG. 10*a* in accordance with the present disclosure.

In addition to building artificial impedance structures using a single layer of conductive structures on a grounded dielectric substrate as disclosed above, an artificial impedance structures 150 may also be implemented using multiple layers 120 and 125 containing conductive structures 140 disposed on a grounded dielectric substrate 130, wherein layers 120 and 125 are separated by an additional dielectric spacer layer 135, as shown in FIGS. 10*a* and 10*b*. A conductive layer 155 may be utilized as a grounding layer for the grounded dielectric substrate 130. FIG. 10*a* depicts a top view of the artificial impedance structure 150 and FIG. 10*b* depicts a side view of the artificial impedance structure 150. The impedance of the artificial impedance structure 150 can be varied by varying the geometry of the conductive structures 140, or by varying the thickness or dielectric constant of the spacer layer 135, or by varying the thickness or dielectric constant or magnetic permeability of the grounded dielectric substrate 130.

The artificial impedance structures presently described may be made using a variety of materials, including any dielectric for the substrates 35, 130, and any periodic or nearly periodic conductive pattern for conductive structures 40, 140, and any solid or effectively solid conductive layer 155 on the bottom surface of the substrate 130. The top surface of the substrate 130 can also consist of multiple surfaces 120, 125 separated by multiple dielectric layers 135.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . "

What is claimed is:

1. A device comprising:

a dielectric layer having generally opposed first and second surfaces;

a conductive layer disposed on the first surface; and a first plurality of conductive structures disposed on the second surface;

wherein the first plurality of conductive structures are arranged in a pattern selected to present a non-uniform impedance profile along the second surface, the non-uniform impedance profile selected to guide electromagnetic waves along the second surface.

2. The device of claim 1, wherein said conductive structures have different impedances.

3. The device of claim 1, wherein said conductive structures have different sizes and/or shapes.

4. The device of claim 1, wherein at least a portion of said conductive structures is coupled electrically to said conductive layer.

5. The device of claim 1, wherein said non-uniform impedance profile is selected to guide electromagnetic waves along the second surface in a preselected direction.

6. The device of claim 1, wherein said first plurality of conductive structures are selected to radiate energy from the electromagnetic waves guided along the second surface in a preselected radiation pattern.

7. The device of claim 1, wherein said device is part of an antenna.

8. The device of claim 1 further comprising:

a spacer layer disposed over said first plurality of conductive structures; and a second plurality of conductive structures disposed over the spacer layer, wherein said first plurality of conductive structures and said second plurality of conductive structures provide the non-uniform impedance profile.

9. A method of using the device of claim 1 to concentrate electromagnetic radiation comprising:

utilizing the non-uniform impedance profile to guide electromagnetic waves along the second surface and concentrate a highest gain radiation lobe of an electromagnetic radiation pattern in a preselected direction away from a direction parallel to the second surface.

10. The device of claim 1, wherein the pattern includes conductive structures of a first size consecutively aligned in a first series and conductive structures of a second size consecutively aligned in a second series adjacent the first series.

11. The device of claim 10, wherein the first and second series are adjacent rows within said pattern.

12. The device of claim 10, wherein the first and second series are adjacent elliptical series within said pattern.

13. The device of claim 1, wherein the pattern includes conductive structures aligned in an elliptical series.

14. The antenna of claim 1, wherein the first plurality of conductive structures includes conductive structures of at least three sizes and/or shapes disposed on the second surface in a pattern defining a continuum or progression of said at least three sizes and/or shapes.

15. The antenna of claim 1, wherein the pattern is a non-repetitive pattern.

16. The antenna of claim 1, wherein the first plurality of conductive structures is electrically separated from the conductive layer.

17. The antenna of claim 1, wherein the first plurality of conductive structures are not disposed between said conductive layer and another conductive layer.

18. The antenna of claim 1, wherein said pattern does not include a respective periodic repetition of conductive structures of different sizes and/or shapes in two normalized directions.

19. A method for manufacturing a device comprising:

providing a dielectric layer having generally opposed first and second surfaces; forming a conductive layer on the first surface; and forming a first plurality of conductive structures on the second surface, wherein said first plurality of said conductive structures are arranged in a pattern to provide a non-uniform impedance profile along the second surface, the non-uniform impedance profile selected to guide electromagnetic waves along the second surface.

20. The method of claim 19, wherein forming the first plurality of conductive structures comprises forming conductive structures with different impedances.

21. The method of claim 20, wherein forming the first plurality of conductive structures comprises forming conductive structures with different impedances to radiate energy from the electromagnetic waves in a preselected radiation pattern.

22. The method of claim 19, wherein forming the first plurality of conductive structures comprises forming conductive structures of different sizes and/or shapes.

23. The method of claim 19, wherein forming the first plurality of conductive structures comprises forming conductive structures that are connected to said conductive layer.

24. The method of claim 19, wherein forming the first plurality of conductive structures comprises forming conductive structures with different impedances to guide the electromagnetic waves along the second surface in a preselected direction.

25. The method of claim 19 further comprising:

forming spacer layer disposed over said first plurality of conductive structures; and forming a second plurality of conductive structures disposed over the spacer layer, wherein said first plurality of conductive structures and said second plurality of conductive structures provide the non-uniform impedance profile.

26. The method of claim 25, further comprising selecting any one or more of the geometry of the first plurality of conductive structures and the second plurality of conductive structures, the thickness of the spacer layer, the dielectric constant of the spacer layer, the thickness of the dielectric layer, or the dielectric constant of the dielectric layer to provide the desired impedance profile.

27. A method for manufacturing an impedance structure, said method comprising:

determining a radiation pattern to be generated by electromagnetic waves propagating along a surface;

determining a desired impedance profile along the surface to generate said radiation pattern;

selecting at least one first conductive structural configuration; and forming a first plurality of structures of different sizes on the surface, each structure within the first plurality of structures having the at least one first conductive structural configuration are arranged in a pattern, so as to provide a non-uniform impedance profile along the surface.

28. The method of claim 27, further comprising:

selecting at least one second conductive structural configuration;

forming a spacer layer disposed over said first plurality structures; and forming a second plurality of structures of different sizes on the spacer layer, each structure within the second plurality of structures having the at least one second conductive structural configuration, wherein said first plurality of structures and said second plurality of structures provide the desired impedance profile along the surface.

29. The method of claim 28, further comprising selecting any one or more of the geometry of the conductive structures, the thickness of the spacer layer, the dielectric constant of the spacer layer, the thickness of the surface, or the dielectric constant of the surface to provide the desired impedance profile.

30. The method of claim 27, wherein the at least one first conductive structural configuration and the at least one second conductive structural configuration are the same.

31. The method of claim 27, wherein the desired impedance profile is non-uniform along the surface.

32. The method of claim 27, wherein the first plurality of structures guide electromagnetic waves along the surface.

* * * * *